US006626023B1

(12) United States Patent
Kodani

(10) Patent No.: US 6,626,023 B1
(45) Date of Patent: Sep. 30, 2003

(54) HYDRAULIC PRESSURE COMPENSATING METHOD AND DEVICE FOR PRESSURE-EQUALIZING APPARATUS FOR PRESSURE PINS

(75) Inventor: Shigeki Kodani, Komatsu (JP)

(73) Assignee: Komatsu Artec Ltd., Komatsu (JP)

( * ) Notice: Subject to any disclaimer, the term of this patent is extended or adjusted under 35 U.S.C. 154(b) by 230 days.

(21) Appl. No.: 09/707,889

(22) Filed: Nov. 8, 2000

(30) Foreign Application Priority Data

Nov. 12, 1999 (JP) ..... 11-322023

(51) Int. Cl.[7] ..... B21D 24/02

(52) U.S. Cl. ..... 72/453.13; 100/35; 100/270; 100/269.14

(58) Field of Search ..... 72/350, 351, 453.13; 100/35, 269.01, 270, 269.03, 269.14

(56) References Cited

U.S. PATENT DOCUMENTS

| | | | | |
|---|---|---|---|---|
| 2,233,164 A | * | 2/1941 | Glasner | 72/455 |
| 5,295,383 A | * | 3/1994 | Kirii et al. | 72/351 |
| 5,361,615 A | * | 11/1994 | Kirii et al. | 72/19.8 |
| 5,457,980 A | * | 10/1995 | Kirii et al. | 72/351 |
| 5,528,918 A | * | 6/1996 | Kirii | 72/15.1 |
| 5,735,201 A | * | 4/1998 | Hirao et al. | 100/269.01 |

FOREIGN PATENT DOCUMENTS

| | | | |
|---|---|---|---|
| JP | 5-69050 | * | 3/1993 |
| JP | 5-285556 | * | 11/1993 |
| JP | 6-190464 | * | 7/1994 |

* cited by examiner

*Primary Examiner*—Allen Ostrager
*Assistant Examiner*—Shelley Self
(74) *Attorney, Agent, or Firm*—Armstrong, Westerman & Hattori, LLP.

(57) ABSTRACT

A pressing machine with fewer breakdowns in a hydraulic pressure compensating device for a pressure-equalizing apparatus for pressure pins is provided. For this purpose, a hydraulic pressure compensating method includes the steps of connecting the pressure-equalizing circuit (42) and the oil feeding means (25) according to hydraulic pressure of the pressure-equalizing circuit (42) and predetermined preloading pressure at an outlet port of the oil feeding means (25) to thereby set the hydraulic pressure of the pressure-equalizing circuit (42) at the preloading pressure, when the hydraulic pressure of the pressure-equalizing circuit (42) decreases after the completion of a forming operation from peak pressure at the time of completion of the forming operation and becomes smaller than a predetermined value, and after setting the same at the preloading pressure, disconnecting the oil feeding means (25) and the pressure-equalizing circuit (42), and continuing the disconnection until the hydraulic pressure of the pressure-equalizing circuit (42) in an next forming. operation decreases from the peak pressure and becomes smaller than the predetermined value once again.

2 Claims, 11 Drawing Sheets

HYDRAULIC PRESSURE COMPENSATING METHOD AND DEVICE FOR PRESSURE-EQUALIZING APPARATUS FOR PRESSURE PINS

TECHNICAL FIELD

The present invention relates to a hydraulic pressure compensating method and device for a pressure-equalizing apparatus for pressure pins of a pressing machine.

BACKGROUND ART

A pressing machine is a machine for forming a work piece such as a metal plate, which is carried in, between a vertically movable upper die and a lower die placed to face the upper die. An outline of a pressing machine equipped with a conventional pressure-equalizing apparatus for pressure pins (for example, Japanese Patent No. 2705393) will be explained with reference to FIGS. 6 and 7. FIG. 7 is an enlarged view of a pressure-equalizing apparatus illustrated in FIG. 6.

An upper die 1 is attached on an underside surface of a slide 2 movable up and down by means of a slide driving mechanism (not illustrated). A press carrier 5 is movably placed on a bed 50 of the pressing machine, and a bolster 4 is placed on a top portion of the press carrier 5. The bed 50 is equipped with a die cushion device 9, a cushion cylinder 9*b* fixed to a cushion rod 9*j* inside the die cushion device 9 is movable up and down. A cushion pad 10 is placed on the cushion cylinder 9*b* so as to be in contact therewith and separate therefrom, and a pressure-equalizing plate 26 is attached on the cushion pad 10. A plurality of pressure-equalizing cylinders 8 are attached on the top surface of the pressure-equalizing plate 26, and a pressure-equalizing piston 8*b* is slidably inserted in each of the pressure-equalizing cylinders 8. A lower end portion of a pressure pin 7 abuts to the pressure-equalizing piston 8*b*, and an upper end surface of each pressure pin 7 supports a lower die 3.

An oil chamber 8*d* of each of the pressure-equalizing cylinders 8 communicates with a pressure-equalizing circuit 42 formed inside the pressure-equalizing plate 26, and the pressure-equalizing circuit 42 is connected with a hydraulic pump 25 via a pipe line 15. The applied pressure, which is applied when the descending upper die 1 forms a work piece 18, is transmitted to the oil chambers 8*d* of a plurality of the pressure-equalizing cylinders 8 via a plurality of the pressure pins 7 and the pistons 8*b*, and the applied pressure is equalized by a plurality of the pressure-equalizing cylinders 8 communicated with one another.

An air chamber 52 defined by a cushion piston 9*a* and the cushion cylinder 9*b* is supplied with air of predetermined air pressure from an air source 9*f* via a regulator 9*g* and an air tank 9*h*. The cushion rod 9*j* penetrating in an axial direction is placed at a center portion of the cushion cylinder 9*b*, and an upper end of the cushion rod 9*j* is fixed to the cushion cylinder 9*b*.

In the pressing machine equipped with the pressure-equalizing apparatus for the pressure pins having the configuration as above, a hydraulic control of the oil chamber 8*d* of each pressure-equalizing cylinder 8 to equalize the applied pressure is carried out in accordance with a method shown in FIG. 8.

The oil chamber 8*d* of each pressure-equalizing cylinder 8 communicates with one another via the pressure-equalizing circuit 42 of the pressure-equalizing plate 26. An electromagnetic valve 20 is placed at an inlet side of a hydraulic port at one end of the pressure-equalizing circuit 42, and an electromagnetic valve 21 is placed at an outlet side of the hydraulic port at the other end. The oil of an oil tank 29 is fed to the pressure-equalizing circuit 42 via the electromagnetic valve 20 at the inlet side by means of the hydraulic pump 25, and the pressure oil from the electromagnetic valve 21 at the outlet side is returned to the oil tank 29. The electromagnetic valve 20 at the inlet side and the electromagnetic valve 21 at the outlet side have two positions: an electromagnetic valve open position 27 and an electromagnetic valve closed position 28. The electromagnetic valve operates in the electromagnetic valve closed position 28 when an off signal is inputted, and it operates in the electromagnetic valve open position 27 when an on signal is inputted.

A hydraulic pressure signal detected by a hydraulic pressure detector 22 for detecting the hydraulic pressure at the hydraulic port at the other end of the pressure-equalizing plate 26, and a positional signal from a position detector 24 for detecting the position of the slide 2 are inputted into a controller 23. On/off signals to the electromagnetic valve 20 at the inlet side and the electromagnetic valve 21 at the outlet side are outputted from the controller 23 respectively.

When the slide 2 with the upper die 1 being attached thereto descends to form the work piece 18, the electromagnetic valve 20 at the inlet side and the electromagnetic valve 21 at the outlet side remain in the electromagnetic valve closed position 28. When the position detector 24 detects that the slide 2, which has completed forming, ascends and reaches approximately the upper dead center, the on/off signals are outputted to the electromagnetic valve 20 at the inlet side and the electromagnetic valve 21 at the outlet side. In this situation, when the on signal is outputted to the electromagnetic valve 20 at the inlet side, the OFF signal is outputted to the electromagnetic valve 21 at the outlet side, and the ON/OFF signals are alternately and repeatedly outputted in this manner so that the control is carried out to make the hydraulic value detected by the hydraulic pressure detector 22 approach a predetermined hydraulic value.

When the hydraulic value detected by the hydraulic pressure detector 22 is sufficiently close to the predetermined hydraulic value, both the electromagnetic valve 20 at the inlet side and the electromagnetic valve 21 at the outlet side are in the closed position 28, and the hydraulic pressures of the oil chambers 8*d* of all the pressure-equalizing cylinders 8 are maintained at the predetermined hydraulic value.

In the above art, however, the following disadvantage arises.

The electromagnetic valve 20 at the inlet side and the electromagnetic valve 21 at the outlet side are mounted near the pressure-equalizing plate 26 to make it easy to control the hydraulic pressures of the pressure-equalizing cylinders 8 at predetermined hydraulic pressure. Since the pressure-equalizing plate 26 is placed on a cushion pad 10, which is always subjected to vigorous vibrations and impacts, the electromagnetic valve 20 at the inlet side and the electromagnetic valve 21 at the outlet side are always subjected to the vigorous vibrations and impacts. Iron powders and oil splashes come into and scatter at the top portions of the pressure-equalizing cylinders 8 placed under the bolster 4 from holes in the bolster 4 in which the pressure pins 7 ascend and descend. Hence, the electromagnetic valve 20 at the inlet side and the electromagnetic valve 21 at the outlet side are always exposed to an atmosphere with iron powders and oil splashes. As a result, oil enters the electromagnetic valve 20 at the inlet side and the electromagnetic valve 21 at the outlet side to frequently produce trouble, thus causing the disadvantage of reducing availability of the pressing machine.

SUMMARY OF THE INVENTION

The present invention is made in view of the aforementioned disadvantage, and its object is to provide a pressing machine with fewer breakdowns in a hydraulic pressure compensating device for a pressure equalizing apparatus.

In order to attain the above object, a hydraulic pressure compensating method for a pressure-equalizing apparatus for pressure pins according to the present invention is a hydraulic pressure compensating method for a pressure-equalizing apparatus for pressure pins, for compensating a hydraulic pressure value of a pressure-equalizing circuit by connecting oil feeding means to a pressure-equalizing circuit, which is provided between a lower die and a die cushion device of a pressing machine, and which is communicated with oil chambers of a plurality of pressure-equalizing cylinders for equalizing applied pressure to a work piece during a forming operation to thereby equalize hydraulic pressure, and including the steps of connecting the pressure-equalizing circuit and the oil feeding means according to hydraulic pressure of the pressure-equalizing circuit and predetermined preloading pressure at an outlet port of the oil feeding means to thereby set the hydraulic pressure of the pressure-equalizing circuit at the preloading pressure, when the hydraulic pressure of the pressure-equalizing circuit decreases after the completion of the forming operation from peak pressure at the time of completion of the forming, and becomes smaller than a predetermined value, and after setting the same at the preloading pressure, disconnecting the oil feeding means and the pressure-equalizing circuit, and continuing the disconnection until the hydraulic pressure of the pressure-equalizing circuit in an next forming operation decreases from the peak pressure and becomes smaller than the predetermined value once again.

According to the above configuration, at the time of completion of the forming of the work piece, the hydraulic pressure inside the pressure-equalizing cylinders has a large peak value, and decreases as it is pulsing. When the hydraulic pressure decreases and becomes smaller than a predetermined value, the oil feeding means is connected to the pressure-equalizing circuit according to the hydraulic pressure of the pressure-equalizing circuit and the preloading pressure. Thereupon, the preloading pressure is exerted on the pressure-equalizing circuit from the oil feeding means. Since a plurality of pressure-equalizing cylinders is connected to the pressure-equalizing circuit, the hydraulic pressures of all the pressure-equalizing cylinders become the preloading pressures. After the hydraulic pressures of all the pressure-equalizing cylinder are set at the preloading pressure, the communication with the oil feeding means is shut off according to the hydraulic pressure of the pressure-equalizing circuit and the preloading pressure. The shutoff of the communication is continued until the hydraulic pressure of the pressure-equalizing circuit at the time of the next forming operation decreases and becomes smaller than the predetermined value once again. As described above, the hydraulic pressures of all the pressure-equalizing cylinders are reset at the preloading pressure for each cycle of the forming operation with the hydraulic pressure of the pressure-equalizing cylinders as a signal. As described above, since the method is for mechanically compensating the hydraulic pressure of the pressure-equalizing cylinders with the hydraulic pressure of the pressure-equalizing cylinder as an input signal, the mechanical type of on-off valve, the switching cylinder and the on-off valve driving mechanism do not break down, even if oil enters them when they are subjected to vigorous vibrations and impacts and operated in an atmosphere with iron powders and oil splashes. As a result, failure of the pressure compensating device is decreased, thus making it possible to obtain the pressing machine with higher availability.

A hydraulic pressure compensating device for a pressure-equalizing apparatus for pressure pins according to the present invention is a hydraulic pressure compensating device for a pressure-equalizing apparatus for pressure pins including a plurality of pressure pins for supporting a lower die of a pressing machine, a plurality of pressure-equalizing cylinders, which support the respective pressure pins and are communicated with one another via a pressure-equalizing circuit for equalizing hydraulic pressure, and oil feeding means for feeding oil to the pressure-equalizing circuit, and has the configuration including:

a mechanical on-off valve for opening and closing communication between an outlet port of the oil feeding means having predetermined preloading pressure and the pressure-equalizing cylinders;

a switching cylinder with a bottom chamber being connected to the outlet port of the oil feeding means and a head chamber having a smaller pressure receiving area than that of the bottom chamber being connected to the pressure-equalizing circuit; and an on-off valve driving mechanism for operating the on-off valve to an open position and thereafter returning the same to a closed position, in an extension process in which the switching cylinder is extended when the hydraulic pressure of the pressure-equalizing circuit decreases from peak pressure at the completion of a forming operation and becomes smaller than a predetermined value and the product of the preloading pressure and a pressure receiving area of the bottom chamber becomes larger than the product of hydraulic pressure of the pressure-equalizing cylinder and the pressure receiving area of the head chamber, and for always holding the on-off valve in a closed position in a process in which the switching cylinder is retreated.

According to the above configuration, when the upper die descends from the top dead center and the forming of the work piece is completed, and when the upper die ascends after the completion of the forming, the switching cylinder is extended and contracted with the hydraulic pressure varying inside the pressure-equalizing cylinders as an signal. The on-off valve driving mechanism opens and closes the on-off valve and controls the hydraulic pressure of the pressure-equalizing cylinders based on the extending and contracting amount of the switching cylinder. As described above, with the totally mechanical type of pressure compensating device for the pressure-equalizing apparatus for pressure pins, even if oil enters the mechanical on-off valve, the switching cylinder, and the on-off valve driving mechanism when they are subjected to vigorous vibrations and impacts and operated in an atmosphere with iron powders and the oil splashes, they do not break down. Consequently, the breakdown of the pressure-compensating device is decreased, thus making it possible to obtain the pressing machine with higher availability.

BRIEF DESCRIPTION OF THE DRAWINGS

FIG. 2A is an explanatory diagram of the present embodiment during the forming of the work piece, FIG. 2B is a diagram explaining a position of the upper die, and FIG. 2C is a diagram explaining a time period and pressure of pressure-equalizing cylinders in the position of the upper die in FIG. 2B;

FIG. 3A is an explanatory diagram of a configuration of the present embodiment after the separation from the work piece, FIG. 3B is a diagram explaining the position of the upper die, and FIG. 3C is a diagram explaining a time period and pressure of the pressure-equalizing cylinders in the position of the upper die in FIG. 3B;

FIG. 4A is an explanatory diagram of a configuration of the present embodiment just before the contact with the work piece, FIG. 4B is a diagram explaining the position of the upper die, and FIG. 4C is a diagram explaining a time period and pressure of the pressure-equalizing cylinders in the position of the upper die in FIG. 4B;

FIG. 5A is a diagram showing the pressure of the pressure-equalizing cylinders by a prior art, and FIG. 5B is a diagram showing the pressure of the pressure-equalizing cylinders by the present embodiment;

BEST MODE FOR CARRYING OUT THE INVENTION

A preferred embodiment according to the present invention will be explained below with reference to the drawings.

Figure 1:
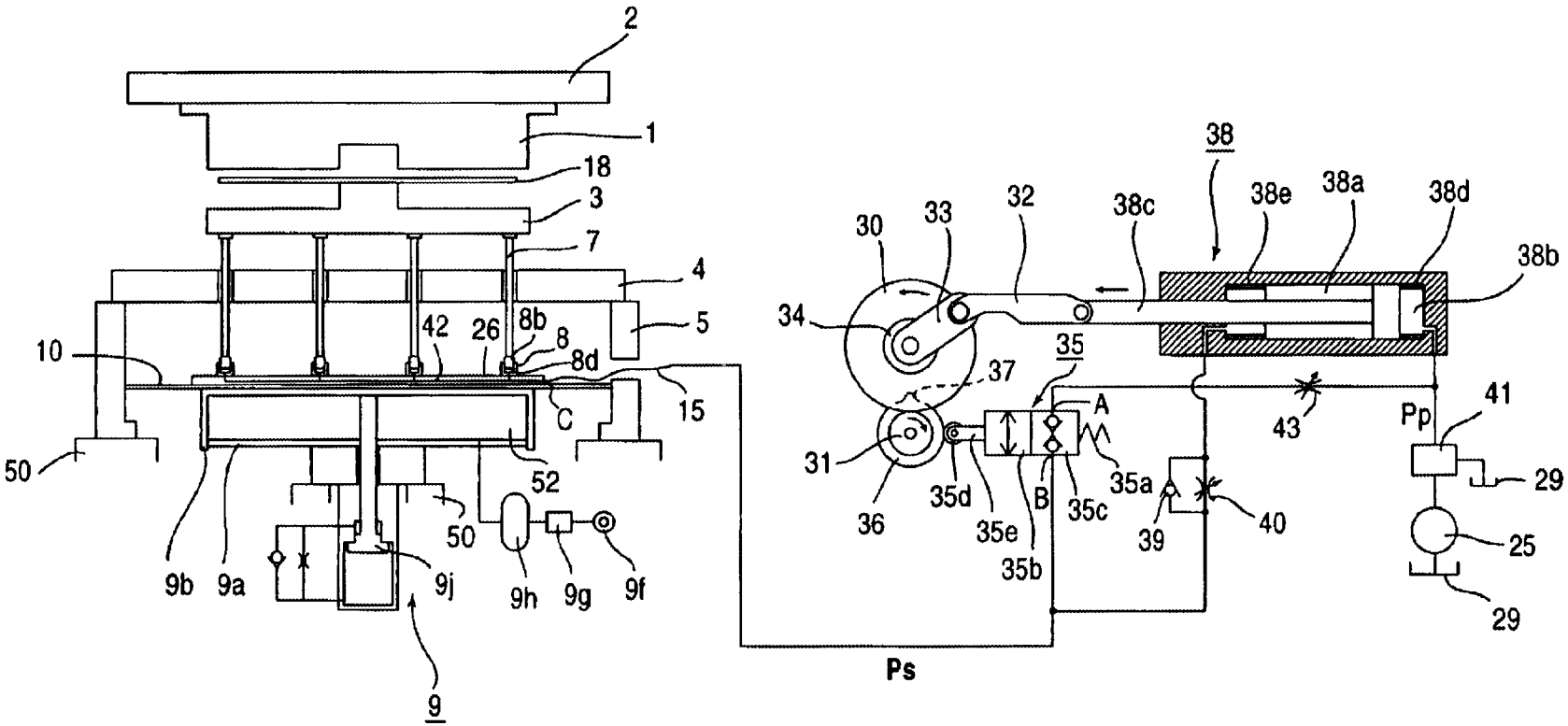
FIG. 1 is a block diagram of an embodiment according to the present invention.
Figure 6:
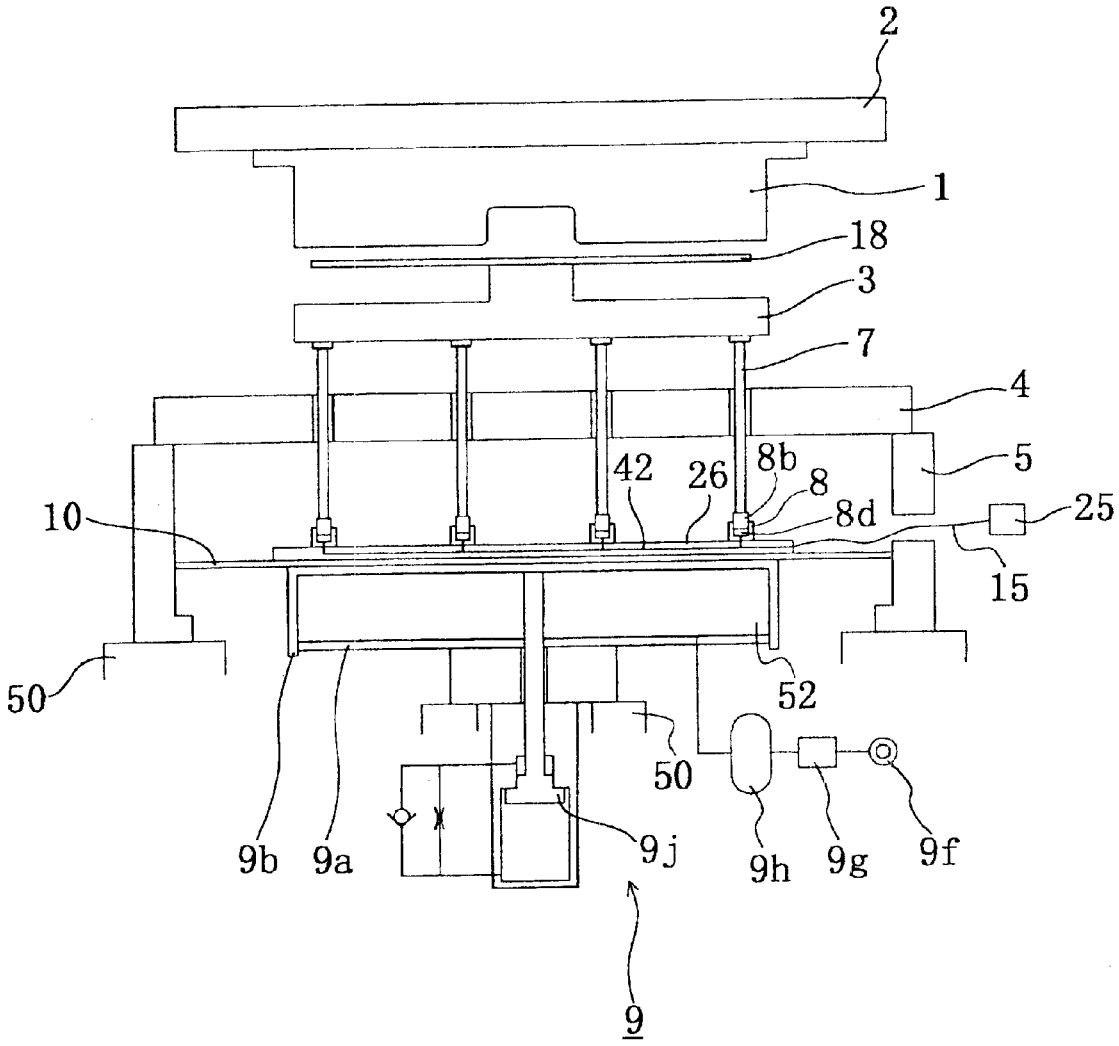
FIG. 6 PRIOR ART
FIG. 6 is an explanatory view of a pressing machine according to the prior art.
Figure 7:
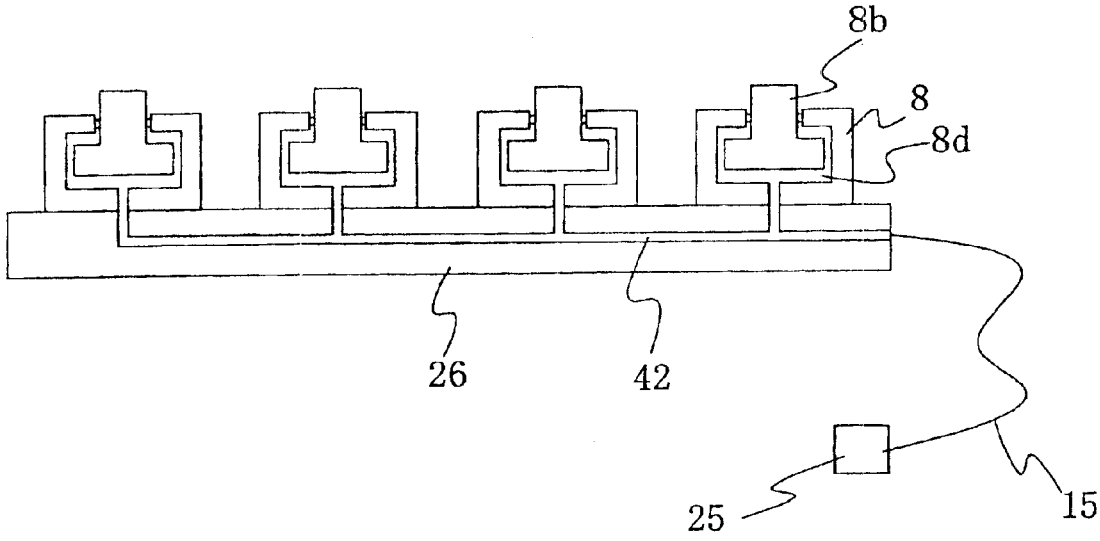
F I G. 7 PRIOR ART
FIG. 7 is an explanatory view of a pressure-equalizing apparatus in FIG. 6.
Figure 8:
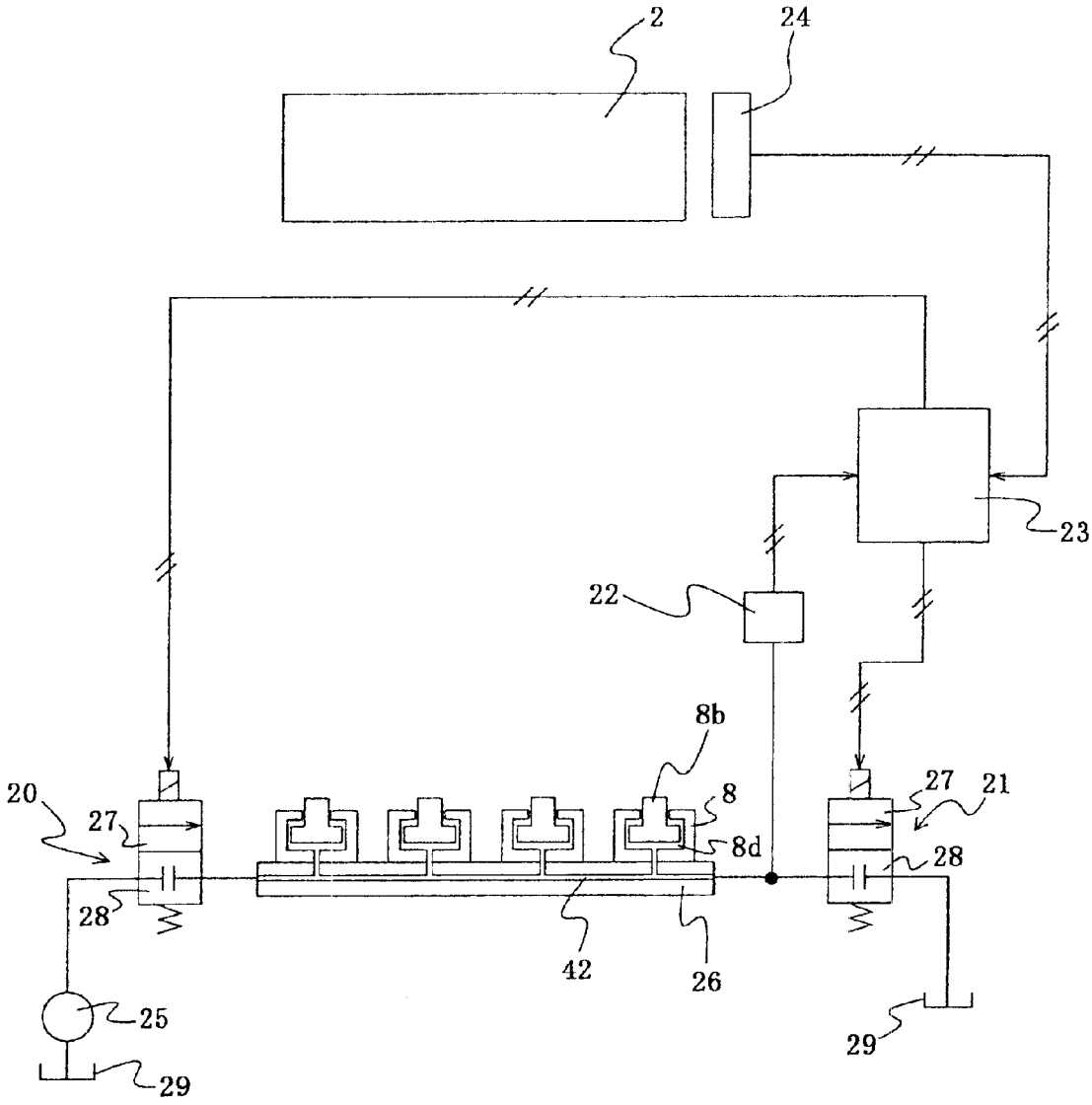
FIG. 8 PRIOR ART
FIG. 8 is an explanatory diagram of a hydraulic pressure compensating method of the prior art for the pressure-equalizing apparatus.

This embodiment is an example in which a conventional pressure-compensating device for a pressure-equalizing apparatus for pressure pins, which is composed of an electromagnetic valve 20 at an inlet side, an electromagnetic valve 21 at an outlet side, a hydraulic pressure detector 22, a position detector 24 and a controller 23, is made a totally mechanical type of pressure-compensating device composed of totally mechanical elements. With reference to FIG. 1, the configuration of this embodiment will be explained. The same elements as those in FIG. 6 will be explained with use of the identical reference numerals.

A switching cylinder 38 is a cylinder provided with a rod (hereinafter called a switching rod 38*c*) only at one side of the cylinder, and has a first stopper 38*d* for limiting extension and contraction amount of the cylinder in a bottom chamber 38*b*, and a second stopper 38*e* in a head chamber 38*a*. Pressure of an oil chamber 8*d* of a pressure-equalizing cylinder 8 and a preloading pressure Pp are inputted in the switching cylinder 38, and the hydraulic pressure of the pressure-equalizing cylinder 8 is controlled by extending and contracting it based on these hydraulic pressure values.

One end of a first lever 32 is rotatably attached at a tip end of the switching rod 38*c* of the switching cylinder 38 and the other end of the first lever 32 is rotatably attached at one end of a second lever 33. The other end of the second lever 33 is attached at an input shaft of a ratchet 34 attached at a center of a first gear 30. An output shaft of the ratchet 34 is attached at the center of the first gear 30. A second gear 31 having the number of gears which is one third of that of the first gear 30 is meshed with the first gear 30, and the second gear 31 is loaded with a cam 36 rotating synchronously with the rotation of the second gear 31.

A cam follower 35*d*, which abuts to a cam surface of the cam 36, is provided at one end of a spool 35*e* of an on-off valve 35 having two positions, a open position 35*b* and a closed position 35*c*. The other end of the spool 35*e* is held under tension force of a spring 35*a*. When a cam protuberance portion 37 of the cam 36 is not abutted to the cam follower 35*d*, the on-off valve 35 operates in the closed position 35*c* by the tension force of the spring 35*a*. When the cam protuberance portion 37 is abutted to the cam follower 35*d*, the spool 35*e* moves against the tension force of the spring 35*a*, thus operating the on-off valve 35 to the open position 35*b*. The element, which is composed of the first lever 32, the second lever 33, the ratchet 34, the first gear 30, the cam 36, and the second gear 31, is called an on-off valve driving mechanism.

A hydraulic pump 25 as oil feeding means driven by air or the like sucks and discharges oil from an oil tank 29. A regulator 41 for setting discharge pressure at predetermined preloading pressure Pp is placed at a discharge side (specifically, an outlet) of the hydraulic pump 25. An outlet side of the regulator 41 having the set preloading pressure Pp is connected to the bottom chamber 38*b* of the switching cylinder 38, and is also connected to a hydraulic port A of the on-off valve 35 via a throttle valve 43 by hydraulic piping. The preloading pressure Pp is, for example, 343N per one square centimeter. A hydraulic port C of a pressure-equalizing plate 26 communicating with oil chambers 8*d* in pressure-equalizing cylinders 8 is connected to a hydraulic port B of the on-off valve 35. A pressure-equalizing circuit 42 communicated with a plurality of oil chambers 8*d* is placed inside the pressure-equalizing plate 26, and the hydraulic port C is a supply port for oil to the pressure-equalizing circuit 42. The hydraulic port C is connected to one end of a parallel circuit composed of a check valve 39 and a throttle valve 40. The other end of the parallel circuit composed of the check valve 39 and the throttle valve 40 is connected to the head chamber 38*a*.

Here, the relationship between the extension and contraction of the switching rod 38*c* of the switching cylinder 38 and the rotation of the cam 36 of this embodiment having the aforementioned configuration will be explained.

When the switching rod 38*c* extends leftward, the other end of the first lever 32 presses the one end of the second lever 33 in an upper left direction. The second lever 33 is then rotated in a counterclockwise direction (hereinafter called CCW) around the other and of the second lever 33 placed at the center of the first gear 30.

When the input shaft of the ratchet 34 is rotated CCW, the ratchet 34 is set so that.the output shaft of the ratchet 34 is also rotated CCW. As a result of the setting, when the second lever 33 is rotated CCW, the first gear 30 is also rotated CCW. When the input shaft of the ratchet 34 is rotated in a clockwise direction (hereinafter, called CW), the output shaft of the ratchet 34 is not rotated. Specifically, when the switching rod 38*c* is retreated to contract, the second lever 33 is rotated CW, but the first gear 30 is not rotated but remains in its position.

When the switching rod 38*c* extends and the second lever 33 is rotated CCW to rotate the first gear 30 CCW, the second gear 31, which-is meshed with the first gear 30, is rotated in the CW direction at the rotational angle which is the three times as large as that of the first gear 30.

Next, the relationship between a vertical position of a slide 2 and the extending and contracting state of the switching rod 38*c* will be explained with reference to FIG. 2A to FIG. 2C, FIG. 3A to FIG. 3C, and FIG. 4A to FIG. 4C.

Figure 2A:
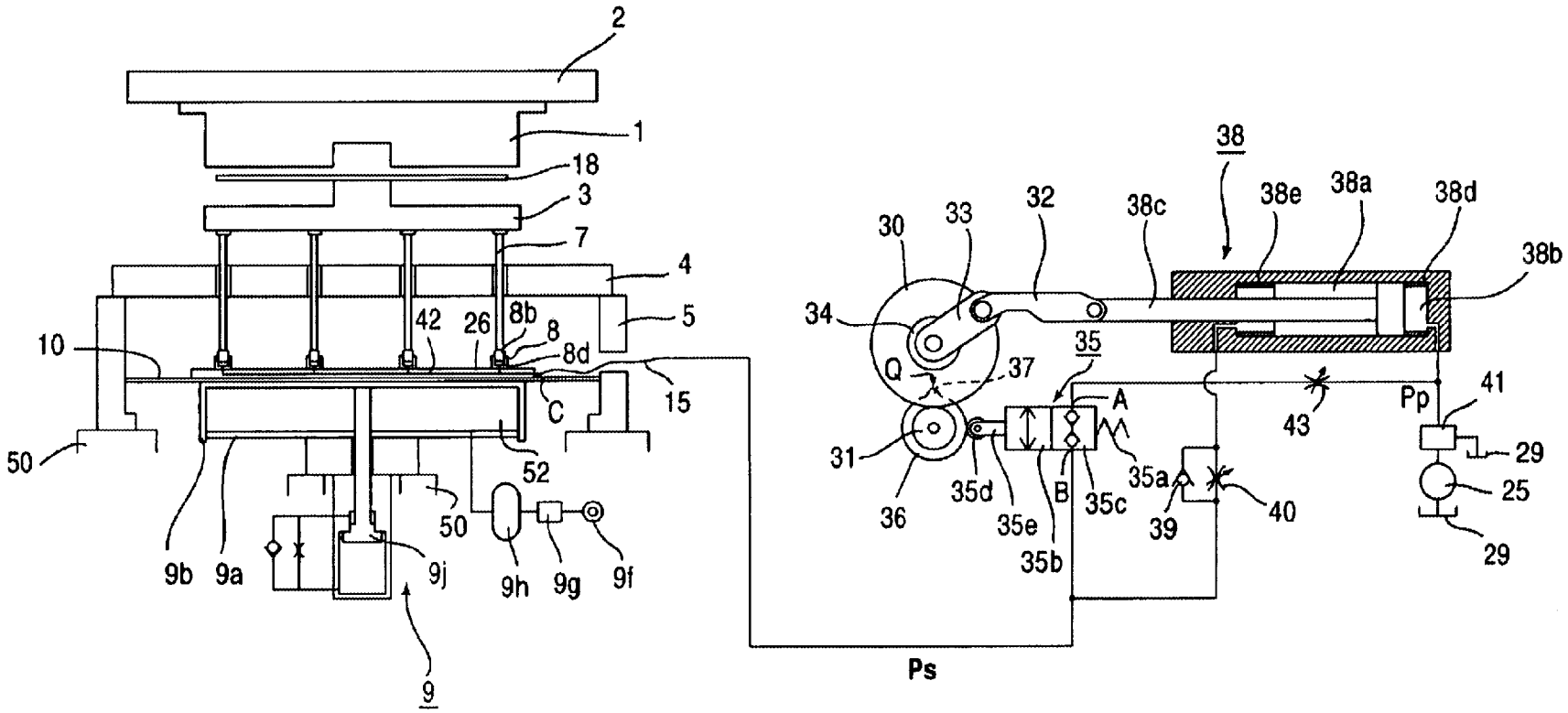
FIG. 2A, FIG. 2B and FIG. 2C are diagrams for explaining an operation during a work piece forming operation of an upper die according to a present embodiment.
Figure 2B:
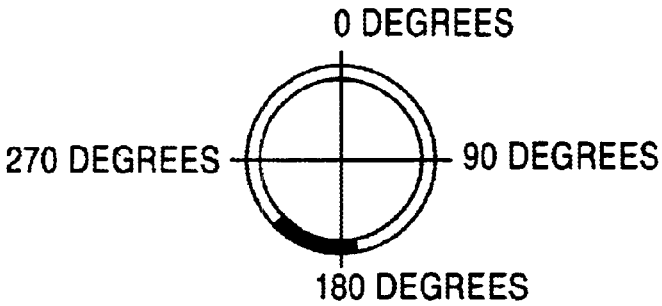
Figure 2C:
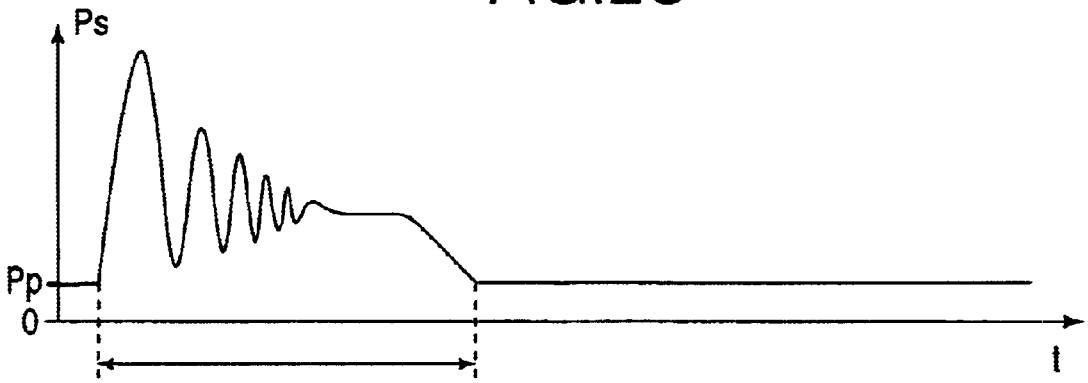

FIG. 2A to FIG. 2C show the situation in which an upper die 1 attached to the slide 2 contacts a work piece 18, reaches the bottom dead center while forming the work piece 18, and completes the forming, which is just before the upper die 1 is separated from the work piece 18. A pie chart in FIG. 2B shows a cycle of operation in which the slide 2 starts descending from the top dead center and returns to the top dead center after reaching the bottom dead center. The portion painted black in this pie chart represents the position in which the upper die 1 contacts the work piece 18 and forms the work piece 18 until the time just before it is separated from the work piece 18 thereafter. The time for this position is the time period shown by the arrow in FIG. 2C in which a time t is set at the horizontal axis and the pressure-equalizing cylinder pressure Ps of the oil chamber 8*d* of the pressure-equalizing cylinder 8 is set at the vertical axis.

As shown in FIG. 2C, the pressure-equalizing cylinder pressure Ps of the oil chamber 8*d* of the pressure-equalizing cylinder 8 in this time period instantaneously rises sharply when the upper die 1 completes the forming of the work piece 18 to form peak pressure, and then gradually diminishes as it is pulsing. This series of pulse of hydraulic pressure is called residual pressure.

The residual pressure is exerted on the head chamber 38*a* of the switching cylinder 38 via the throttle valve 40. On the other hand, the predetermined preloading pressure Pp set by the regulator 41 is exerted on the bottom chamber 38*b* of the switching cylinder 38. Here, pressure receiving areas are set so that the force computed by multiplying the residual pressure and the pressure receiving area of the head chamber 38*a* is greater than the force computed by multiplying the preloading pressure Pp and the pressure receiving area of the bottom chamber 38*b*. By this setting, the switching rod 38*c* is retreated to contract as shown in FIG. 2A and is stopped at the position of the first stopper 38*d* for limiting the retreat.

In this situation, an angle formed by the second lever 33 and the horizontal line is, for example, 35 degrees if the horizontal line in a rightward direction from the center of the first gear 30 is assumed to be zero degrees. The cam protuberance portion 37 formed on the cam surface of the cam 36 is at an original position Q which is 90 degrees rotation in the CCW direction from the line connecting the center of the cam 36 and the center of the cam follower 35*d*. In the on-off valve 35, the cam protuberance portion 37 prevents the cam follower 35*d* from being displaced rightward, and thus the on-off valve 35 operates in the closed position 35*c* under the tension force of the spring 35*a*.

Figure 3A:
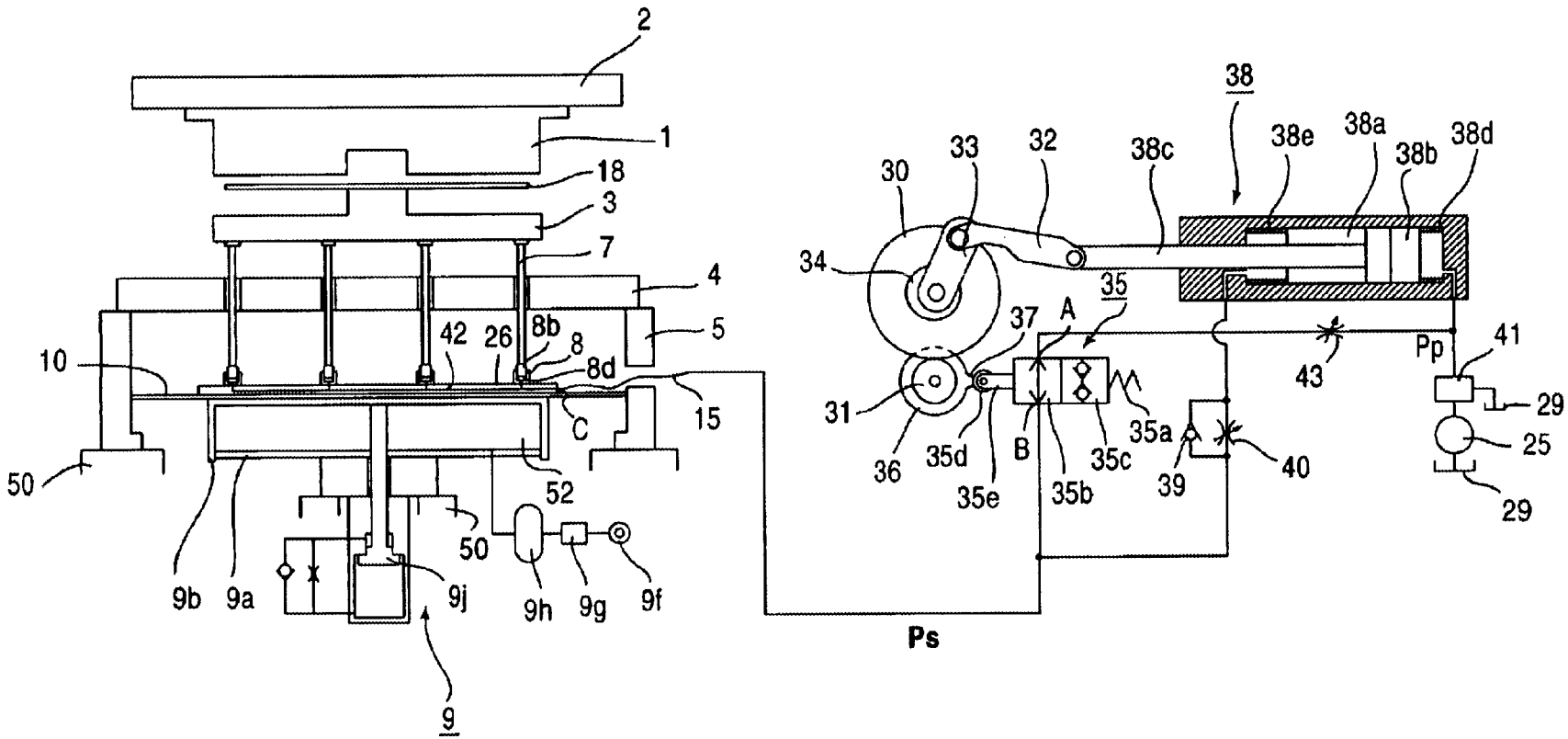
FIG. 3A, FIG. 3B, and FIG. 3C are diagrams explaining the operation after the upper die is separated from the work piece according the present embodiment.
Figure 3B:
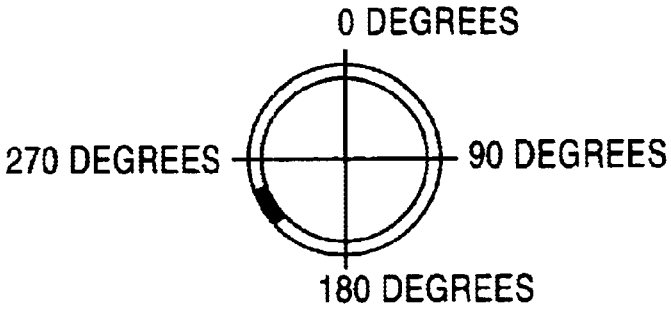
Figure 3C:
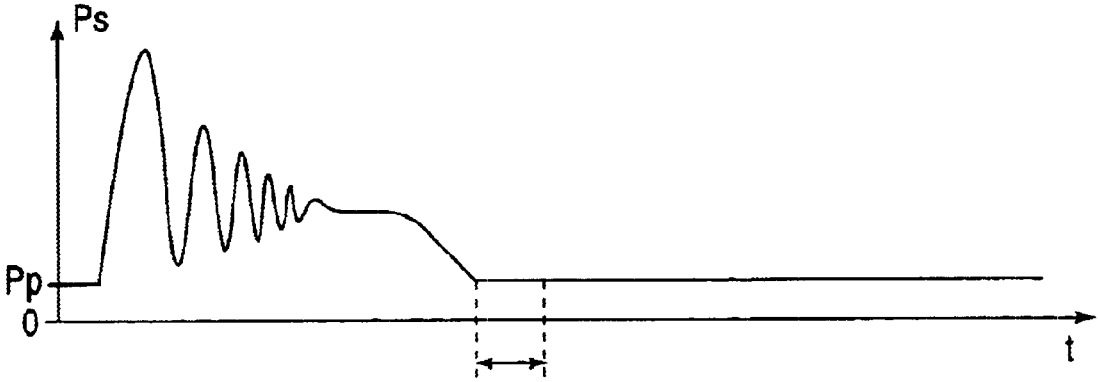

FIG. 3A to FIG. 3C show the situation in which the upper die 1 attached to the slide 2 completes the forming and is separated from the work piece 18 and the residual pressure of the pressure-equalizing cylinders 8 disappears. The portion painted black in FIG. 3B represents the position from the time after the residual pressure disappears until the on-off valve 35 is operated to the open position 35*b*. The time for this position is the time period shown by the arrow in FIG. 3C.

When the upper die 1 is separated from the work piece 18, the residual pressure disappears and the hydraulic pressure of the head chamber 38*a* decreases, and since the preloading pressure Pp is exerted on the bottom chamber 38*b*, the switching rod 38*c* is extended. In this situation, oil in the head chamber 38*a* flows back to the oil chambers 8*d* of the pressure-equalizing cylinders 8 via the check valve 39. When the switching rod 38*c* is extended to rotate the second lever 33 CCW and the second lever 33 is rotated 30 degrees further from the position at 35 degrees, the second gear 31 is rotated 90 degrees CW. As a result, the cam protuberance portion 37 is rotated up to the position of the cam follower 35*d*, and presses the cam follower 35*d* rightward against the tension force of the spring 35*a*. Thereby, the on-off valve 35 operates to the open position 35*b*, then the preloading pressure Pp set by the regulator 41 is exerted on the oil chambers 8*d* of the pressure-equalizing cylinders 8 via the throttle valve 43, and thus the pressure-equalizing cylinder pressure Ps of the oil chambers 8*d* of the pressure-equalizing cylinders 8 is set at the preloading pressure Pp. In this situation, the shape of the cam protuberance portion 37 and the degree of throttling the throttling valve 43 are set so that the pressure-equalizing cylinder pressure becomes the preloading pressure Pp in a predetermined time.

FIG. 3A shows the situation at the moment when the on-off valve 35 operates to the open position 35*b*. Immediately after this moment, the pressure-equalizing cylinder pressure, Ps of the oil chambers 8*d* is set at the preloading pressure Pp, and the switching rod 38*c* is moved to the position at which it is most extended and is stopped at the position by the second stopper 38*e*.

Figure 4A:
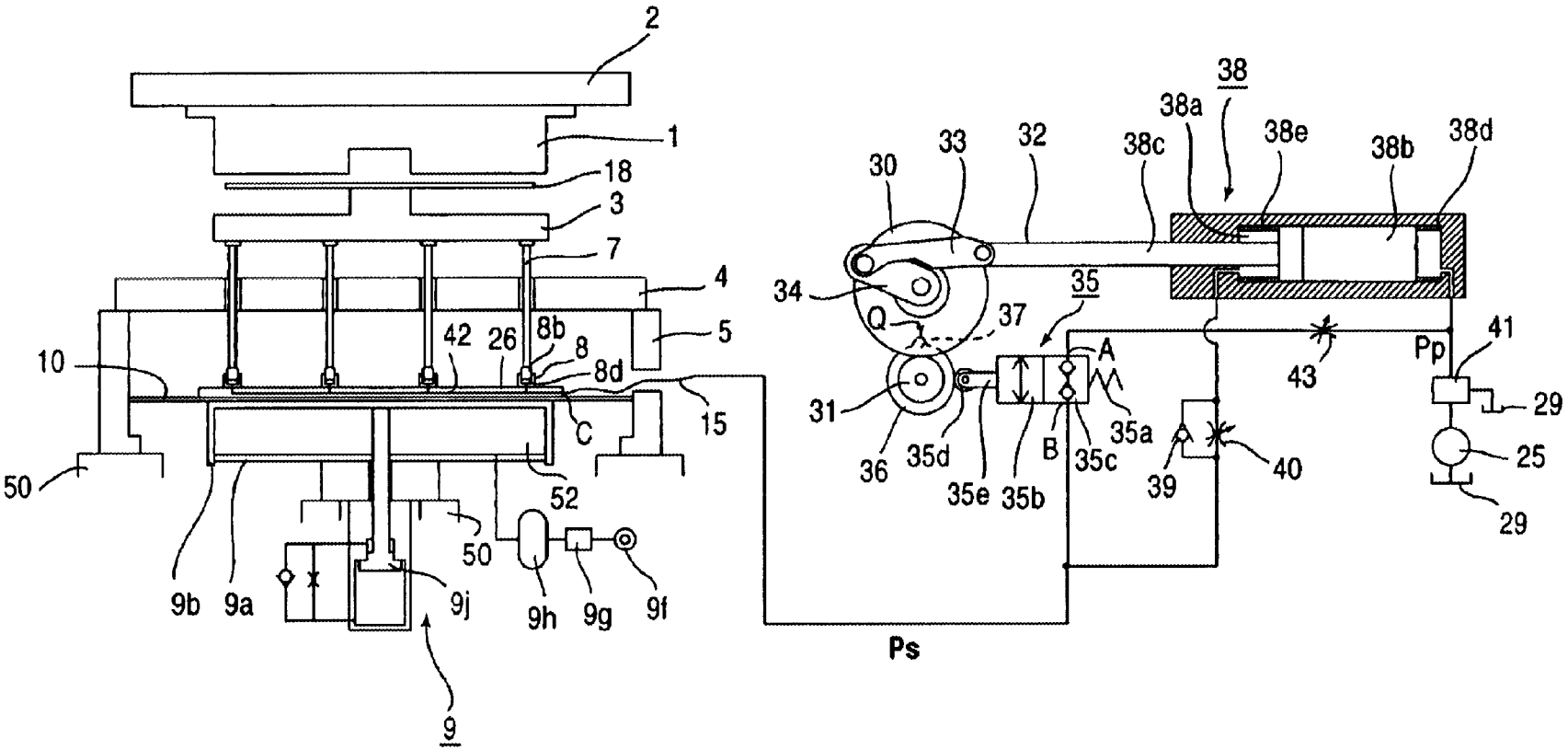
FIG. 4A, FIG. 4B and FIG. 4C are diagrams explaining an operation from the time after the upper die is separated from the work piece until the upper die is in contact with the work piece once again.
Figure 4B:
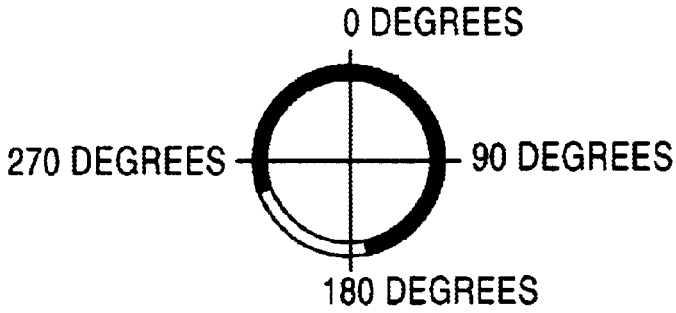
Figure 4C:
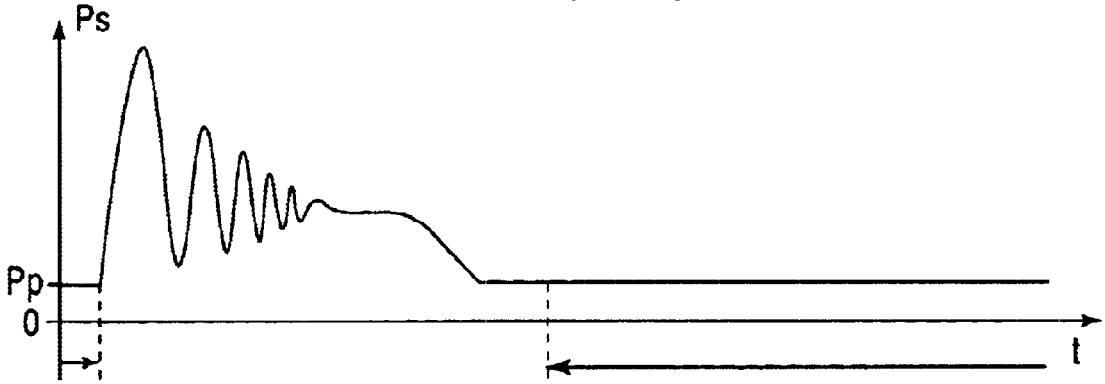

FIG. 4A to FIG. 4C show the situation in which the upper die 1 attached to the slide 2 is completely separated from the work piece 18, returns to the top dead center of the upper die 1 and starts descending again, until the time just before the upper die 1 is abutted to the work piece 18 once again. The portion painted black in FIG. 4B represents the position from the time at which the upper die 1 is separated from the work piece 18 until it is abutted to the work piece 18 once again. The time for the position is the time period shown by the arrow in FIG. 4C. Specifically, it is the time period from the point of time when the cam protuberance portion 37 is returned to the original position Q until the time when the peak pressure at the next forming rises.

At this time, the pressure-equalizing cylinder pressure Ps of the oil chambers 8*d* is already set at the preloading pressure Pp, and as shown in FIG. 4A, the switching rod 38*c* is moved to the position at which it is most extended and is stopped at the position by the second stopper 38*e*. This position is the position in which the second lever 33 is further rotated 90 degrees CCW from the position at the angle of the second lever 33 at the time of the cam protuberance portion 37 pressing the cam follower 35*d* rightward. Specifically, the cam 36 is in the position in which it is further rotated 270 degrees CW, and the cam protuberance portion 37 is in the position in which it is rotated 360 degrees from the position shown in FIG. 2A to return to the original position. By the cam follower 35*d* being returned to the original position by the tension force of the spring 35*a*, the on-off valve 35 operates to the closed position 35*c*.

When the upper die 1 descends and abuts to the work piece 18 once again to complete the forming, the pressure-equalizing cylinder pressure Ps of the oil chambers 8*d* is changed to the residual pressure, and therefore the residual pressure is exerted on the head chamber 38*a* via the throttle valve 40. As a result, since the force to retreat the switching rod 38*c*, which is exerted from the head chamber 38*a*, is larger than the force to extend the switching rod 38*c* from the bottom chamber 38*b*, the switching rod 38*c* is retreated to the first stopper 38*d*. The throttling degree of the throttle valve 40 is set so that the speed at which the switching rod 38*c* is retreated becomes a predetermined speed. In this situation, the second lever 33 is rotated 120 degrees CW, but since the output shaft of the ratchet 34 is not rotated when the input shaft of the ratchet 34 is rotated CW, the first gear 30 is not rotated and remains in its position.

Next, the operational effects of the present embodiment will be explained.

Initially, the operation and effects provided by this embodiment being the totally mechanical type of pressure compensating device will be explained. When the slide 2 of the pressing machine is at the top dead center before the operation, no load is exerted on the pressure pins 7, and therefore the pressure-equalizing cylinder pressure Ps of the oil chambers 8*d* of the pressure-equalizing cylinders 8 for supporting the pressure pins 7 is small. In this situation, since the preloading pressure Pp is exerted on the bottom chamber 38*b* of the switching cylinder 38, the switching rod 38*c* is extended up to the position of the second stopper 38*e*. By the first gear 30 and the second gear 31, which are rotated in relation to the extension of the switching rod 38*c*, the cam protuberance portion 37 is positioned in the original position Q, which is 90 degrees rotation CCW from the line connecting the center of the cam 36 and the center of the cam follower 35*d*. In this situation, the on-off valve 35 operates in the closed position 35*c*.

When the slide 2 starts descending, and the upper die 1 abuts to the work piece 18 and completes the forming, load is exerted on the pressure-equalizing cylinders 8 via the pressure pins 7, and the pressure-equalizing cylinder pressure Ps of the oil chambers 8*d* is increased to, for example, 3430N per one square centimeter. Since this large hydraulic pressure is exerted on the head chamber 38*a*, the switching rod 38*c* is instantaneously retreated to the position of the first stopper 38*d*. When the switching rod 38*c* is retreated, the second lever 33 is rotated CW, but the first gear 30 is not rotated and remains in its position by the effect of the ratchet 34. As a result, the second gear 31 and the cam 36 are not rotated, and remain in their positions.

After the upper die 1 completes the forming of the work piece 18 and is separated from the work piece 18, the load exerted on the pressure pins 7 is only the weight of the lower die 3 and the work piece 18, and thus the residual pressure exerted on the head chamber 38*a* of the switching cylinder 38 decreases. When the force computed by multiplying the preloading pressure Pp of the switching cylinder 38 and the pressure receiving area of the bottom chamber 38*b* becomes larger than the force computed by the decreasing residual pressure and the pressure receiving area of the head chamber 38*a*, the switching rod 38*c* starts extending. When the switching rod 38*c* extends, the second lever 33 is rotated CCW. When the second lever 33 is rotated CCW, the output shaft of the ratchet 34 is rotated CCW, and thus the first gear 30 attached at the output shaft of the ratchet 34 is rotated CCW. When the second lever 33 is rotated 30 degrees CCW from the position of the second lever 33 in which the switching rod 38*c* is most retreated, the second gear 31 having the number of gears which is one third of that of the first gear 30 is rotated 90 degrees CW. As a result of the rotation, the cam protuberance portion 37 is abutted to the cam follower 35*d*, thereby mechanically switching the on-off valve 35 to the open position 35*b*.

When the on-off valve 35 is switched to the open position 35*b*, the preloading pressure Pp is exerted on the oil chambers 8*d*, and thus the pressure-equalizing cylinder pressure Ps of the oil chambers 8*d* is set at the preloading pressure Pp. Since the preloading pressure Pp is also exerted on the head chamber 38*a* and the bottom chamber 38*b*, the switching rod 38*c* is extended to the position of the second stopper 38*e* and stopped. From the time when the cam protuberance portion 37 is abutted to the cam follower 35*d* until the switching rod 38*c* is extended to the position of the second stopper 38*e* and stopped, the second lever 33 is rotated 90 degrees CCW. The cam protuberance portion 37 is rotated 270 degrees CW and returned to the original position Q.

As described above, the pressure-compensating device is designed to be the totally mechanical type of the pressure-compensating device for the pressure-equalizing apparatus for the pressure pins controlling the hydraulic pressure of the pressure-equalizing cylinders 8 via the mechanical operations of the first and the second lever, the first and the second gear, the ratchet 34, the cam 36, the cam follower 35*d* and the on-off valve 35 by extending and contracting the switching rod 38*c* of the switching cylinder 38 with the hydraulic pressure changing in the pressure-equalizing cylinders 8 as a signal when the upper die 1 descends from the top dead center and abuts to and forms the work piece 18. As a result, when the mechanical on-off valve, the switching cylinder and the on-off valve driving mechanism are operated while being subjected to vigorous vibrations and impacts in an atmosphere with iron powders and oil splashes, even if oil enters them, it does not cause failure. Thus the failure of the pressure-compensating device is reduced, thereby making it possible to obtain the pressing machine with higher availability. Further, expensive detectors, electromagnetic valves and the controller 23 are not required, thus making it possible to obtain a less expensive pressure-compensating device for the pressure-equalizing apparatus for the pressure pins.

Next, the operation and effects of the control of the residual pressure by changing various factors of the switching cylinder 38 and the cam 36 will be explained. When the upper die 1 is abutted to the work piece 18 and completes the forming, the hydraulic pressure of the pressure-equalizing cylinders 8 reaches a large peak value, and thereafter it diminishes as it is pulsing. Subsequently, the pressure-equalizing cylinder pressure Ps takes on hydraulic pressure values in correspondence to the compressing force varying in accordance with the ascending position of the upper die 1, and returns to approximately the preloading pressure Pp. In this situation, the pulse of the hydraulic pressure occurring after the peak pressure causes large noises and mechanical vibrations.

Thus, in order to avoid the pulsing of the hydraulic pressure pulse the pressure-equalizing cylinder pressure Ps reaches the peak pressure, the pressure receiving areas of the bottom chamber 38*b* and the head chamber 38*a* are set so that the switching rod 38*c* of the switching cylinder 38 starts to extend immediately after the peak pressure occurs. Specifically, by reducing the pressure receiving area of the head chamber 38*a*, the start of the extension of the switching rod 38*c* is advanced. Thus the cam protuberance portion 37 presses the cam follower 35*d* earlier, thereby operating the on-off valve 35 to the open position 35*b*. In this situation, if the operation of the on-off valve 35 to the open position 35*b* is started too early, the hydraulic pressure of the pressure-equalizing cylinder 8 becomes the preloading pressure Pp during the forming in which the upper die 1 is ascending after it descends, and the forming cannot be achieved. In order to avoid this, extension of the switching rod 38*c* is started early by setting the pressure receiving area of the head chamber 38*a* to be small, and the position and the shape of the cam protuberance portion 37 are set so that the on-off valve 35 is gradually operated to the open position 35*b*.

Figure 5A:
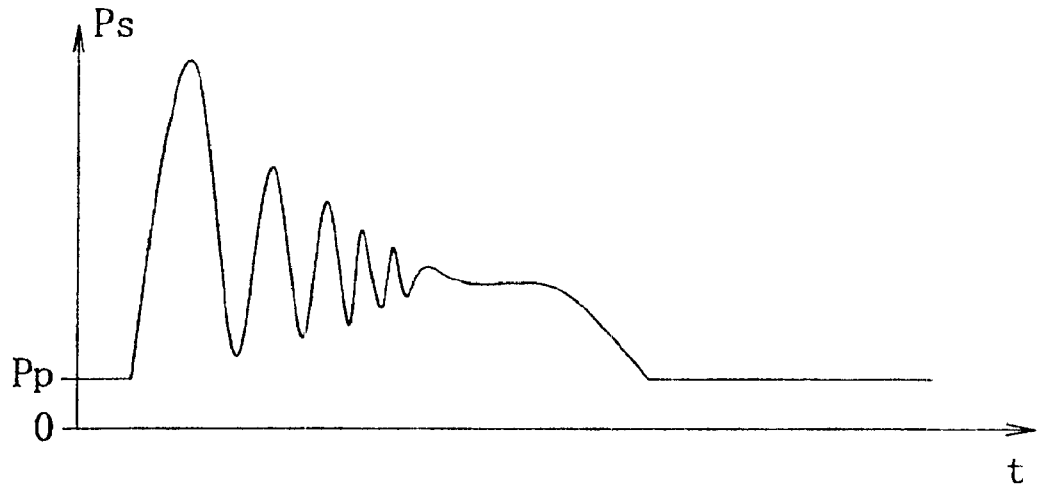
FIG. 5A PRIOR ART
FIG. 5A and FIG. 5B are diagrams for comparing the pressures of the pressure-equalizing cylinders with and without a residual pressure control.
Figure 5B:
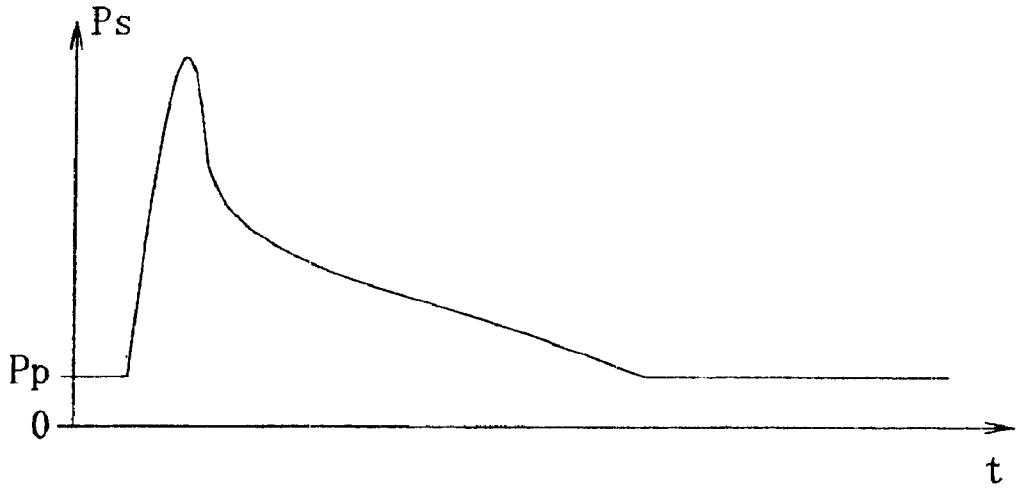

The comparison between the pressure-equalizing cylinder pressures Ps by the prior art and the present embodiment are respectively shown in FIG. 5A and FIG. 5B. In FIG. 5A, the pressure-equalizing cylinder pressure Ps by the prior art is shown, in which it abruptly reduces after the peak pressure occurs, and thereafter it repeatedly pulses to return to approximately the preloading pressure Pp. The pressure-equalizing cylinder pressure Ps by the present embodiment is shown in FIG. 5B, in which the pressure-equalizing cylinder pressure Ps gradually decreases without pulsing after the peak pressure.

According to the present embodiment described above, the pressure-equalizing cylinder pressure Ps gradually settles at the preloading pressure Pp by gradually starting the operation of the on-off valve 35 to the open position 35*b* from early time after the peak pressure, thus preventing the pressure-equalizing cylinder pressure Ps from abruptly reducing. Further, in the time period in which pulsing occurs in the prior art, since the on-off valve 35 operates in the open position 35*b* in the present embodiment and the oil chambers 8*d* communicate with the oil tank 29 via the hydraulic pump 25 or the regulator 41, the pulsing of the hydraulic pressure does not occur.

Thus the working force between the upper die 1 and the work piece 18 is always maintained properly, therefore making it possible to obtain excellent form quality. Further, since the pulsing of the pressure-equalizing cylinder pressure Ps does not occur, a pressing machine with low noise and fewer mechanical vibrations can be obtained.

In the present embodiment, the preloading pressure Pp is set by the regulator 41 provided at the discharge port of the hydraulic pump 25 as the oil feeding means, but instead of the hydraulic pump 25 and the regulator 41, an accumulator set at the preloading pressure Pp may be used as the oil feeding means. Further, the number of gears of the second gear is set to be one third of that of the first gear, but if only it is under the condition that the second gear makes one rotation, specifically it rotates 360 degrees, when the switching rod 38*c* is extended, it may be set to be, for example, one fourth and is not limited to one third.

As described thus far, according to the present invention, the hydraulic pressure of the pressure-equalizing circuit communicating with the oil chambers of a plurality of pressure-equalizing cylinders is taken out as a signal, and the switching cylinder is extended and contracted according to the hydraulic pressure force taken out. The extending and contracting switching rod of the switching cylinder is connected to the input end of the on-off valve driving mechanism. The switching rod is extended when the hydraulic pressure of the pressure-equalizing circuit decreases to a predetermined value after the peak pressure occurs during forming, and the on-off valve driving mechanism switches the operation of the mechanical on-off valve from the closed position to the open position. When the on-off valve is in the open position, the preloading pressure is supplied to the pressure-equalizing circuit from the oil feeding means having predetermined fixed preloading pressure, and the hydraulic pressures of all the pressure-equalizing cylinders are set at the preloading pressure. After the hydraulic pressure of the pressure-equalizing circuit is set at the preloading pressure, the on-off valve driving mechanism returns the operation of the on-off valve to the closed position. The operation in the closed position is continued until the hydraulic pressure of the pressure-equalizing circuit decreases to a predetermined value after the peak pressure of the next forming occurs. In this manner, the hydraulic pressure of the pressure-equalizing cylinder is taken out as a signal, and according to the hydraulic pressure, the hydraulic pressures of the pressure-equalizing cylinders are mechanically set at the preloading pressure for each cycle of the forming operation. As a result, the totally mechanical type of pressure compensating method and device for the pressure-equalizing apparatus for the pressure pins can be obtained, and thus it does not break down even if oil enters the mechanical on-off valve, the switching cylinder and the on-off valve driving mechanism when they are operated while they are subjected to vigorous vibrations and impacts in an atmosphere with iron powders and oil splashes. As a result, the failure of the pressure-compensating device is reduced, thus making it possible to obtain the pressing machine with higher availability.

What is claimed is:

1. A hydraulic pressure compensating method for use with a pressing machine having a pressure-equalizing means, for compensating a hydraulic pressure value of a pressure-equalizing circuit by connecting an oil feeding means to a pressure-equalizing circuit, which is provided between a lower die and a die cushion device of said pressing machine, and which is communicated with oil chambers of a plurality of pressure-equalizing cylinders for equalizing applied pressure to a work piece during a forming operation, said hydraulic pressure compensating method comprising the steps of:

connecting said pressure-equalizing circuit and said oil feeding means according to hydraulic pressure of said pressure-equalizing circuit and a predetermined preloading pressure at an outlet port of said oil feeding means to thereby set the hydraulic pressure of said pressure-equalizing circuit at the preloading pressure, when the hydraulic pressure of said pressure-equalizing circuit decreases after the completion of the forming operation from a peak pressure at the time of completion of the forming operation and becomes smaller than a predetermined value; and after setting the hydraulic pressure of said pressure-equalizing circuit at the preloading pressure, disconnecting said oil feeding means and said pressure-equalizing circuit, and continuing the disconnection until the hydraulic pressure of said pressure-equalizing circuit in a next forming operation decreases after the completion of the next forming operation from a peak pressure at the time of completion of the next forming operation and becomes smaller than the predetermined value once again, wherein said connecting and said disconnecting of said oil feeding means and said pressure-equalizing circuit is carried out with use of a mechanical type switching cylinder for operating a valve driving mechanism for further operating a valve to connect and disconnect, said switching cylinder:

sensing pressure of said oil feeding means in a bottom chamber of said switching cylinder, sensing a pressure of said pressure-equalizing circuit in a head chamber of said switching cylinder having a smaller pressure receiving area than a receiving area of said bottom chamber, and driving said valve driving mechanism by reaction of said switching cylinder to said sensed pressures, so as to connect and disconnect said oil feeding means and said pressure-equalizing circuit.

2. A hydraulic pressure compensating device for use with a pressing machine having a pressure-equalizing means including a plurality of pressure pins supporting a lower die of the pressing machine, said pressure pins being supported by a plurality of pressure-equalizing cylinders, which are communicated with one another via a pressure-equalizing circuit, and oil feeding means for feeding oil to said pressure-equalizing circuit, said hydraulic pressure compensating device comprising:

a mechanical on-off valve arranged for opening and closing communication between an outlet port of said oil feeding means, having predetermined preloading pressure, and said pressure-equalizing cylinders;

a switching cylinder with a bottom chamber, being connected to the outlet port of said oil feeding means, and a head chamber, having a smaller pressure receiving area than that of said bottom chamber, being connected to said pressure-equalizing circuit; and an on-off valve driving mechanism driven by said switching cylinder, said switching cylinder and said on-off valve driving mechanism arranged for operating said on-off valve to an open position and thereafter returning the on-off valve to a closed position, when the hydraulic pressure of said pressure-equalizing circuit decreases from a peak pressure, at the completion of a forming operation, and becomes smaller than a predetermined value, by said switching cylinder being extended due to the product of the preloading pressure and the pressure receiving area of said bottom chamber becoming larger than the product of the hydraulic pressure of said pressure-equalizing circuit and the pressure receiving area of said head chamber, and said switching cylinder and said on-off valve driving mechanism arranged for holding said on-off valve in the closed position when said switching cylinder is retreated due to the product of the preloading pressure and the pressure receiving area of said bottom chamber becoming smaller than the product of the hydraulic pressure of said pressure-equalizing circuit and the pressure receiving area of said head chamber.

* * * * *